US011385010B1

(12) United States Patent
Rofkahr, Jr. et al.

(10) Patent No.: US 11,385,010 B1
(45) Date of Patent: Jul. 12, 2022

(54) TRIGGER ENERGY ABSORPTION APPARATUS AND METHOD

(71) Applicants: James J. Rofkahr, Jr., Altus, AR (US); Michael D. Rofkahr, Ozark, AR (US)

(72) Inventors: James J. Rofkahr, Jr., Altus, AR (US); Michael D. Rofkahr, Ozark, AR (US)

( * ) Notice: Subject to any disclaimer, the term of this patent is extended or adjusted under 35 U.S.C. 154(b) by 27 days.

(21) Appl. No.: 16/992,323

(22) Filed: Aug. 13, 2020

Related U.S. Application Data

(63) Continuation-in-part of application No. 16/031,352, filed on Jul. 10, 2018, now Pat. No. 10,775,122.

(51) Int. Cl.
*F41A 19/10* (2006.01)
*F41A 19/09* (2006.01)

(52) U.S. Cl.
CPC ..... *F41A 19/10* (2013.01); *F41A 19/09* (2013.01)

(58) Field of Classification Search
CPC ..... F41A 19/10; F41A 35/00; F41A 19/09; F41A 19/11
See application file for complete search history.

(56) References Cited

U.S. PATENT DOCUMENTS

| | | | | |
|---|---|---|---|---|
| 984,519 | A | 2/1911 | Browning | |
| 1,703,464 | A | 2/1929 | Wilshire | |
| 1,909,425 | A | 5/1933 | Reid | |
| 2,865,127 | A | 12/1958 | Finnegan | 42/69 |
| 3,031,786 | A | 5/1962 | Swan | 42/1 |
| 3,188,764 | A * | 6/1965 | Harding | F41A 19/10 42/69.01 |
| 3,713,239 | A * | 1/1973 | Sperling | F41A 17/54 42/70.07 |
| 4,539,889 | A | 9/1985 | Glock | 89/147 |
| 4,551,937 | A | 11/1985 | Seehase | 42/74 |
| 4,555,861 | A | 12/1985 | Khoury | 42/70 |
| 4,691,461 | A | 9/1987 | Behlert | 42/69.01 |
| 4,955,155 | A | 9/1990 | Jones | 42/69.01 |
| 5,060,555 | A | 10/1991 | Sater et al. | 89/196 |
| 5,074,190 | A * | 12/1991 | Troncoso | F41A 19/16 89/136 |
| D388,149 | S * | 12/1997 | Langner | D22/100 |
| 6,164,002 | A * | 12/2000 | Troncoso | F41A 19/09 42/69.01 |
| 6,260,301 | B1 | 7/2001 | Aigner et al. | 42/71.02 |
| 6,526,683 | B1 | 3/2003 | Crandall | 42/40 |
| 7,047,686 | B2 | 5/2006 | Zimmermann | 42/75.1 |
| 7,698,845 | B2 | 4/2010 | Hochstrate et al. | 42/69.03 |
| 9,644,913 | B2 | 5/2017 | Dextraze | 42/69.01 |
| 10,775,122 | B1 | 9/2020 | Rofkahr, Jr. et al. | 42/104 |
| 2017/0191776 | A1 * | 7/2017 | Dextraze | F41A 19/12 |
| 2020/0393213 | A1 * | 12/2020 | Dominguez Vazquez | F41A 25/22 |

* cited by examiner

*Primary Examiner* — Joshua E Freeman
(74) *Attorney, Agent, or Firm* — Keislig & Pieper PLC; David B. Pieper; Trent C. Keisling

(57) ABSTRACT

An elastomer shock absorber for the trigger assembly of a firearm utilizing an elastomer shock absorber positioned between a moving part of the trigger assembly and the frame assembly. Adhesive mounting of the elastomer to the back of the trigger or positioning the elastomer internal to the frame assembly both provide significant reductions in the shock transfer of trigger energy to the gun body, thereby increasing the accuracy of the firearm.

1 Claim, 21 Drawing Sheets

Live Fire Target Grouping Comparisons

Without Device
27.4 sq in Group Area

A

With External Device
6.05 sq in Group Area 4.5X Tighter Group

78% Improvement

B

With Internal Device
4.53 sq in Group Area

6X Tighter Group

84% Improvement

C

Note:

All targets shot with polymer frame pistol (Sig Sauer P320), at distance of 20 yards (60 ft). 12 rounds shot per target.

TRIGGER ENERGY ABSORPTION APPARATUS AND METHOD

CROSS-REFERENCE TO RELATED APPLICATIONS

This application claims priority to and is a continuation-in-part of U.S. patent application Ser. No. 16/031,352, filed on Jul. 10, 2018 entitled TRIGGER ENERGY ABSORPTION APPARATUS AND METHOD which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in triggers and firing mechanisms for firearms. More particularly, the invention relates to improvements particularly suited for lightweight handguns. In one preferred embodiment, the present invention relates specifically to a force absorbing elastomer placed between the finger operated trigger mechanism and the frame assembly of the handgun to absorb the energy of the finger pull, especially after the trigger is releases the firing mechanism such as a sear.

2. Description of the Known Art

As will be appreciated by those skilled in the art, firearms are known in various forms. Patents disclosing information relevant to firearms include: U.S. Pat. No. 6,164,002, issued to Troncoso on Dec. 26, 2000 entitled Gun having a rapid fire trigger assembly and the assembly therefor; U.S. Pat. No. 9,644,913, issued to Dextraze\ on May 9, 2017 entitled Multi-stage trigger mechanism for rifle; U.S. Pat. No. 7,047,686, issued to Zimmermann on May 23, 2006, entitled Versatile M1911-style handgun and improved magazine for rifles and handguns; U.S. Pat. No. 5,060,555, issued to Sater, et al. on Oct. 29, 1991 entitled Slide decelerator for a firearm; U.S. Pat. No. 4,691,461, issued to Behlert on Sep. 8, 1987 entitled Adjustable gun trigger mechanism; U.S. Pat. No. 4,955,155, issued to Jones on Sep. 11, 1990 entitled Pivoting trigger group assembly; U.S. Pat. No. 7,698,845, issued to Hochstrate, et al. on Apr. 20, 2010 entitled Double action model 1911 pistol; U.S. Pat. No. 4,555,861, issued to Khoury on Dec. 3, 1985 entitled Firing pin locking device; U.S. Pat. No. 984,519, issued to Browning on Feb. 14, 1911 entitled Firearm; U.S. Pat. No. 6,260,301, issued to Aigner, et al. on Jul. 17, 2001 entitled Pistol, whose housing is composed of plastic; U.S. Pat. No. 5,060,555, issued to Sater, et al. on Oct. 29, 1991, entitled Slide decelerator for a firearm; U.S. Pat. No. 4,551,937, issued to Seehase on Nov. 12, 1985, entitled Recoil pad utilizing struts disposed at a compound angle and having adjustable energy-absorbing characteristics; and U.S. Pat. No. 4,539,889, issued to Glock on Sep. 10, 1985 entitled Automatic pistol with counteracting spring control mechanism. Each of these patents is hereby expressly incorporated by reference in their entirety.

From these prior references it may be seen that these prior art patents are very limited in their teaching and utilization, and an improved trigger energy absorption apparatus and method is needed to overcome these limitations.

SUMMARY OF THE INVENTION

The present invention is directed to an improved trigger energy absorption apparatus and method using a dampening energy absorbing element. In the process of firing a modern firearm, the trigger is typically designed to release a sear which is under spring tension. The users finger pressure against the trigger builds to the point at which the sear is released, which then releases the hammer or firing pin striker to fire the weapon. When a firearm trigger releases the sear, the constant pull of the user's finger on the trigger accelerates the trigger until it bluntly stops against the frame assembly causing a jarring impact load onto the frame assembly that changes the aim of the weapon before the bullet is fired/exits the barrel. In accordance with one exemplary embodiment of the present invention, a trigger energy absorption device is provided using a dampening elastomer to absorb trigger pull force and dampen trigger shock force transfer to the frame assembly. In its simplest form, the trigger energy absorption device uses a dampening energy absorbing element that fits between the back side of the firearm trigger and the trigger guard. The trigger energy absorption device can be adhesively mounted to a moving part of the trigger assembly or to an element of the frame assembly so that it absorbs the energy from the trigger moving element. In one embodiment, the trigger energy absorption device is precision cut so that it does not engage until after the movement required for the sear release. In this embodiment, the trigger energy absorption device is simply affixed to the trigger guard with a non-marring adhesive to form an inexpensive removable and easily replaceable device. In operation, the trigger is pulled and the rear of the trigger contacts the media and begins compressing it. The device can be sized so that compression can also be used before firing to slightly increase the trigger pull. In both the after firing release contact design and the before firing release contact designs, the after firing release trigger motion is absorbed by the media which prevents the shock load transfer of the destabilizing energy to the firearm frame assembly. The end result is a much more accurate and repeatable firearm action.

One advantage of the present invention is that it increases firearm accuracy by absorbing the kinetic energy of the trigger release preventing abrupt transfer of this energy to the firearm frame assembly which causes shake or instability during firing. The traditional approach to improving firearm accuracy has primarily focused on the aspect of lightening the trigger pull force of a weapon. However, it may be shown that reducing the trigger pull force has the undesirable effect of also reducing safety and causing potential accidental firing of the weapon. Thus, safety is sacrificed by lightening the trigger pull force. It is accepted in the firearm industry that a 4 lb trigger pull weapon may be accidentally fired more often that a 10 lb trigger pull weapon, of the same model, for obvious reasons. It may also be shown that the use of the trigger energy absorbing device, in lieu of lightening the trigger pull, can achieve the same or better accuracy improvement by effectively reducing the velocity component of the Kinetic Energy affecting the firearm, thus inflicting no degradation in safety of the weapon. It may be shown that the use of the Trigger Energy Absorbing Device is a preferred method of increasing firearm accuracy over the traditional approach of lightening the trigger pull, as it relates to the safety of the weapon A further advantage of the present invention is an increase in shot repeatability by providing consistent dampening for a more consistent and repeatable action.

A still further advantage is an increase in trigger reset speed. Due to the fact that the released free trigger movement is limited in the absorption process, the reset distance is essentially shortened, providing improved function.

The invention is adaptable to all standard firearms currently in production that use traditional trigger/sear mechanisms for firing pin or hammer release thereby covering both striker and hammer technology. Examples of the styles of weapons include all varieties of automatic weapons, semi-automatic weapons, revolvers, bolt action pistols, rifles, and shotguns. The invention can also be used in other trigger devices such as air rifles, crossbows, paintball guns.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
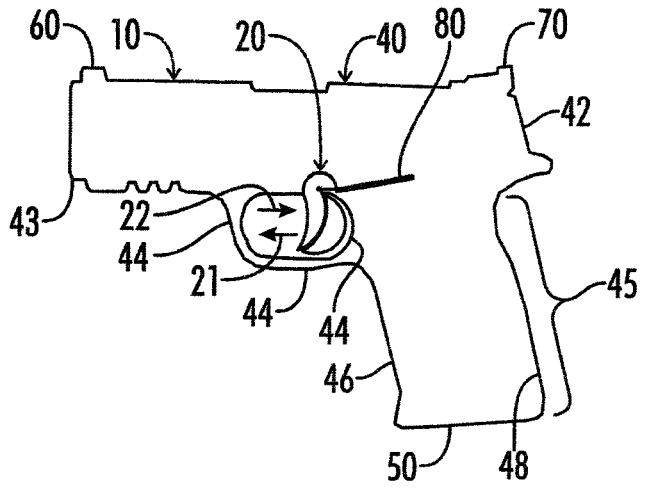
FIG. 1 is a schematic view of a crescent shaped embodiment of a trigger energy absorption device positioned in an uncompressed state between the trigger and the frame assembly of a gun.

As shown in FIGS. 1-24 of the drawings one exemplary embodiment of the present invention is generally shown as a trigger energy absorption device 100 for use with a firearm 10. The firearm 10 generally has a trigger assembly 20 with a trigger body 25 having trigger front 26, trigger back 27, and a movement connection 30 allowing a back pull release motion 22 to fire the bullet from the firearm 10 and a forward reset motion 21 to reset the firearm 10 for the next shot.

Thus, forward and backward are defined by the movement to fire the weapon. The trigger assembly 20 may also include trigger arm 36 moved by the trigger body 25 to release the sear 80.

The movement connection 30 can be a simple trigger pivot 32 or trigger slide 34. The firearm 10 has a gun body 40 with a body frame 42. The body frame assembly 42 includes an upper frame assembly 43, trigger guard 44, and a grip handle 45. The grip handle 45 includes a front strap 46, back strap 48, and side panel 50.

The trigger energy absorption device 100 includes a main body 110 with a body shape 112. The body shape 112 can be a front to back increasing height body shape 113, front to back consistent height body shape 114, front to back decreasing height body shape 115 or front to back varying height body shape 118. FIG. 7 shows a front to back increasing height body shape 113. FIG. 4 shows a front to back consistent height body shape 114. FIGS. 1-3 and FIG. 9 show a front to back decreasing height body shape 115. FIGS. 5, 6, and 8 show a front to back varying height body shape 118. Any body shape 113, 114, 115 can also be made as a hollow body shape 116 with the hole extending in any of the three dimensions. FIG. 9 shows a decreasing body shape 115 as a hollow body shape 116 with body threads 117 formed within the hollow body shape 116 for connection to a mounting structure 170, shown here as a rod mount 172 with mating mounting threads 174 mounted off of the back 27 of the trigger 25. The hollow body shape 116 can have the aperture extend all of the way through the body or can just be a partial depth aperture. The aperture extending all of the way through the body provides the most adjustment range but can expose the end of the rod mount 172. In contrast, a partial hole ensures that a minimum thickness of material is always dampening the trigger. The trigger energy absorption device 100 includes a body front 120, body back 130, body top 140, body bottom 142, left side 144, and right side 146. The main body 110 is made from a dampening body material 150.

The body front 120 can have a body front concave shape 122; body front convex shape 124; body front pointed shape 126; or body front flat shape 128. The body back 130 can have a body back concave shape (not shown); body back convex shape 134; body back pointed shape (not shown); or body back flat shape 138.

The top to bottom height and whether or not a hollow is used in the body shape 112, the shape of the body front 120 and the shape of the body back 130 in relation to the frame 42 affect the amount of elastomer being compressed at any point during the trigger 20 travel. Each of the profiles presented have been proven to work to provide the necessary dampening with different characteristics preferred by the individual user's preferences. The external embodiment shown in FIGS. 1-3 and the internal embodiments in FIGS. 11-16 have provided solid performance in keeping the sight alignment on target.

The dampening body material 150 is preferably an elastomer chosen to quickly return to the starting shape after being compressed by the pull of the trigger 20. This return time is preferably less than the time for firing another round from the firearm 10. The dampening body material 150 may be selected as a softer material for more travel or a harder material to limit the trigger 25 travel for a given force and shape. Embodiments have been successfully made from two part moldable silicon, and both cross-linked and non-cross-linked polyethylene foam. The preferred embodiment is a four pound crosslinked polyethylene with successful tests run with foam density between two and six pound density (lb/cubic ft). Another preferred product for the body material is TPE (thermo plastic elastomer) constructed in a solid, lattice or honeycomb pattern to provide absorption characteristics via compression of the structure. The embodiment of which may be injection molded or 3D printed. Yet another product is SORBOTHANE (trademark) which is the brand name of a synthetic viscoelastic urethane polymer used as a shock absorber and vibration damper. It is manufactured by Sorbothane, Incorporated, 2144 State Route 59, Kent, Ohio 44240. Appropriate absorbing bladder designs may also be used.

The dampening body material 150 should also be chosen based on the expected temperature range to be encountered in relation to the material properties, the depth of travel for the mounting location, the shock absorbing nature of the material including the material dampening characteristics, the light weight of the material, and the microfine air bubble properties of the material. Note that it is preferred that the material would have good oil resistance properties and also have a closed cell construction to minimize contaminants. For example, an open cell polyurethane that is subject to oil penetration can be used, but the service life is negatively impacted by the undesirable characteristics of collecting contamination in the open cell structure. Thus, one might choose a crescent shaped of material based on a summer day with a temperature range between 60 and 90 degrees Fahrenheit, for three eighths of an inch travel after the trigger release, with a ten pound absorption rate within 2 milliseconds of contact or through a 1-3 mm of compression, in an oil resistant closed cell foam.

The trigger energy absorption device 100 may be manufactured from various materials that exhibit shock absorbing characteristics, with the most common and available being medium density closed cell foam. Layered manufacture of the absorbing dampening body material 150 is possible with the most desirable construction using a high density base layer contacting the gun body 40, followed by medium density, and finally low density which will be in contact with the back 27 of the trigger 25. Precision cutting of the material is best performed by a three dimensional layout via computer aided drafting, then water-jet cut. Three dimensional printing is also an option for manufacture. Die cutting of 4# cross linked polyethylene sheet material of ⅜" thickness is the expected manufacture for the external device, while TPE or silicon rubber injection molding is the expected manufacture of the internal device.

Figure 2:
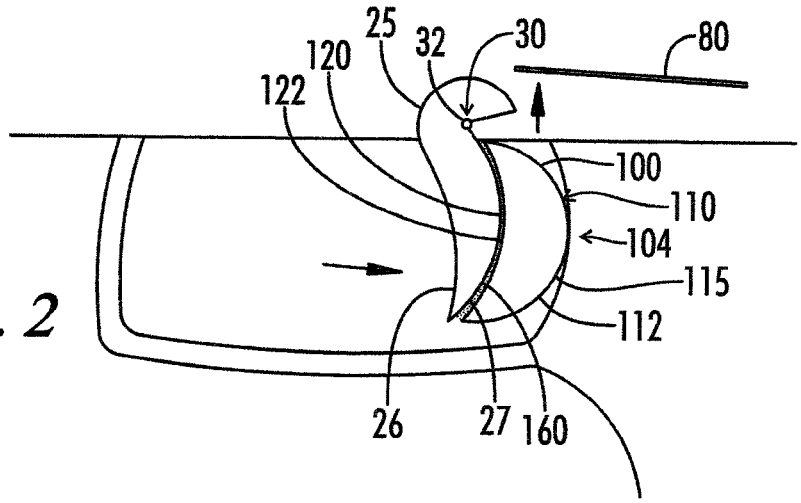
FIG. 2 is a schematic view with the trigger moved to the firing release position.
Figure 3:
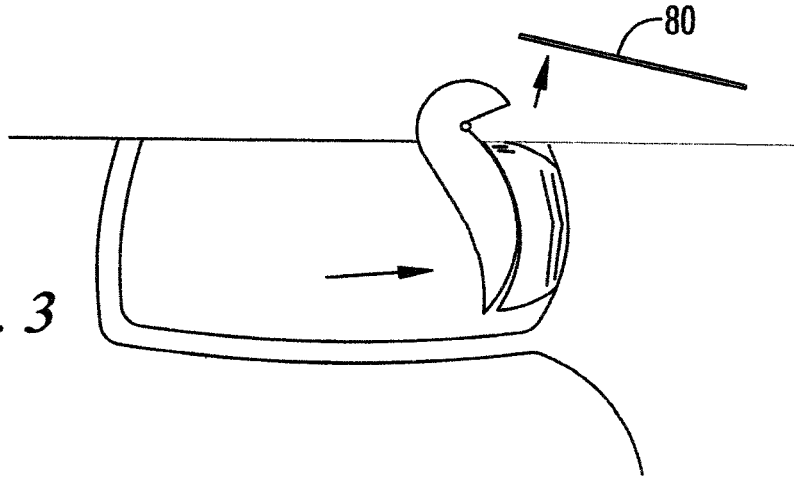
FIG. 3 is a schematic view with the trigger moved past the firing release position and compressing the trigger energy absorption device.
Figure 4:
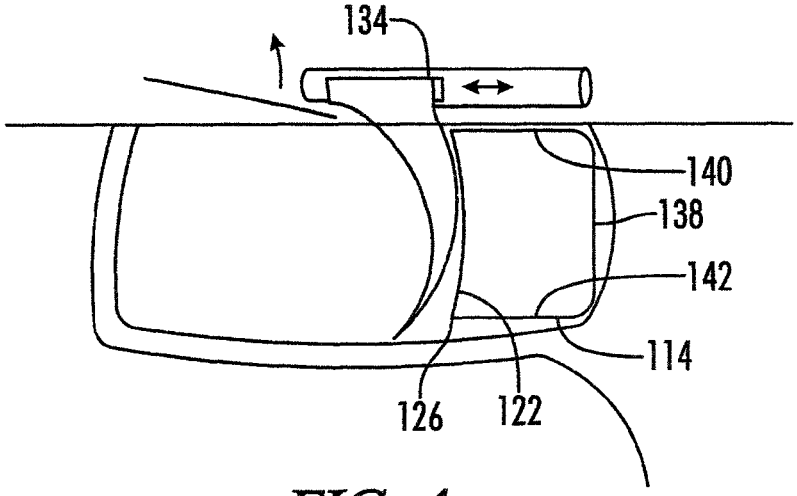
FIG. 4 is a schematic view of a rectangular shaped trigger energy absorption device.
Figure 5:
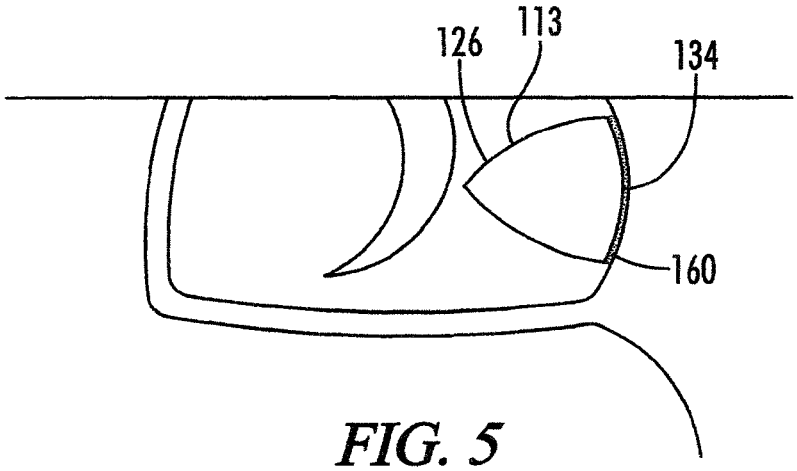
FIG. 5 is a schematic view of an ovate shaped trigger energy absorption device.
Figure 6:
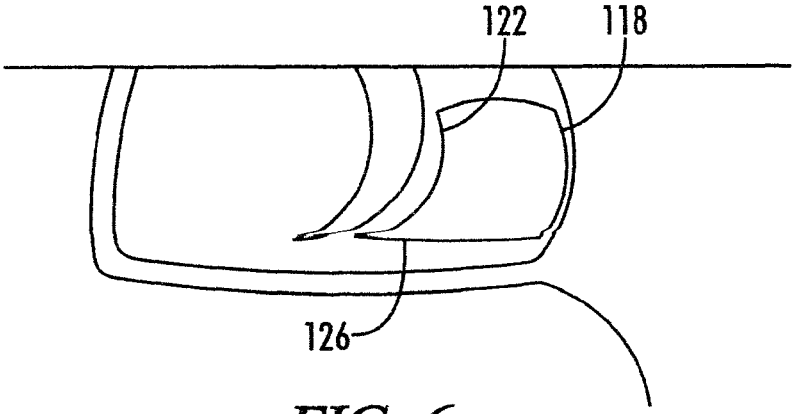
FIG. 6 is a schematic view of a pointed shape trigger energy absorption device.
Figure 7:
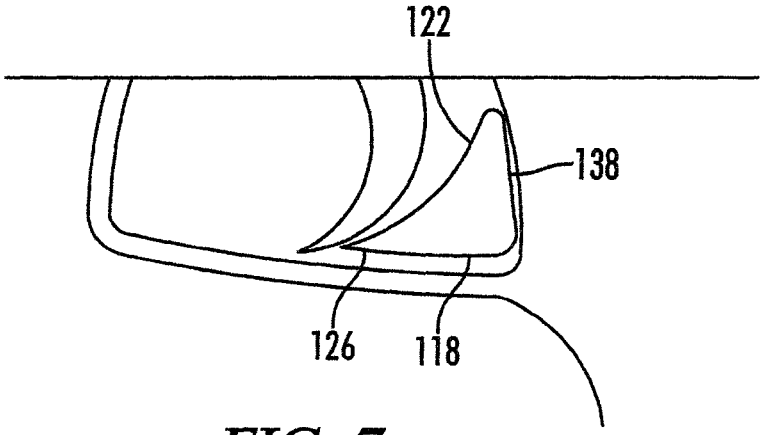
FIG. 7 is a schematic view of a triangular shaped trigger energy absorption device.
Figure 8:
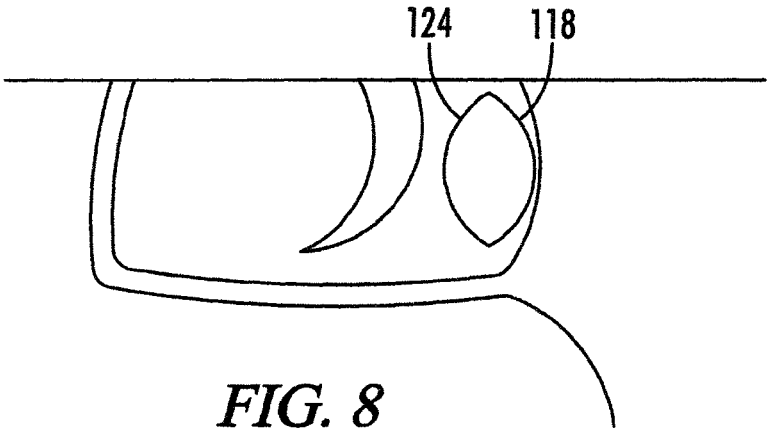
FIG. 8 is a schematic view of an elliptical shape trigger energy absorption device.
Figure 9:
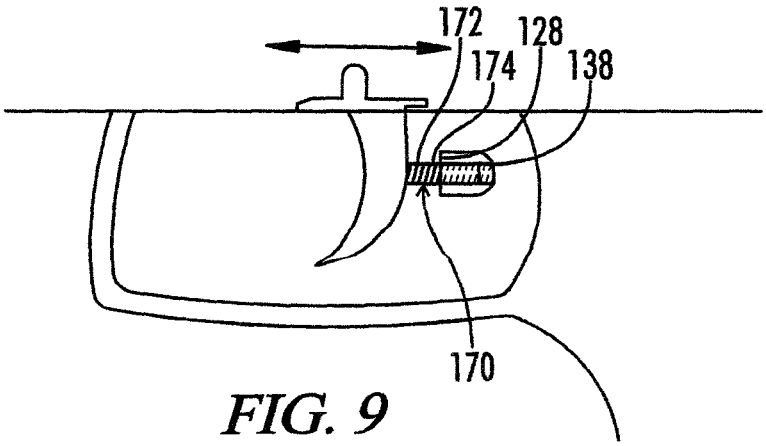
FIG. 9 is a schematic view of a cylindrical shape trigger energy absorption device mounted on a stud.
Figure 10:
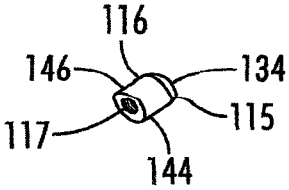
FIG. 10 is a schematic view of a cylindrical shaped trigger energy absorption device.

The trigger energy absorption device 100 can be held in place by being friction fit to the gun mechanism as shown in FIGS. 9, and 12-16 or a body adhesive 160 may be used to mount the trigger energy absorption device 100 to the trigger 25, FIG. 1-3, or the gun body 40, FIGS. 4-8, specifically, the back of the trigger guard 44 at the top front of the grip handle 45.

Figure 11:
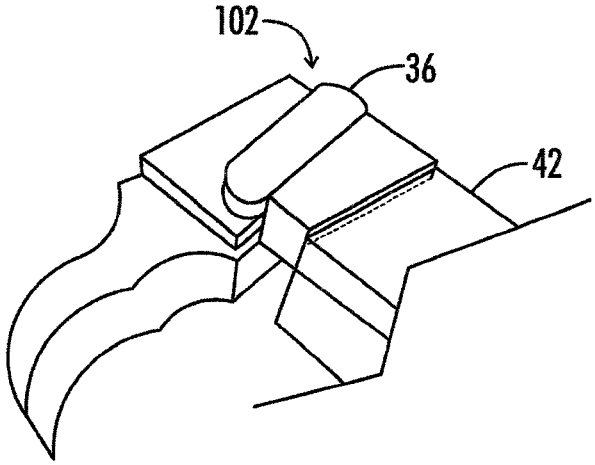
FIG. 11 is a schematic view of an internal L shaped trigger energy absorption device mounted on an internal frame assembly.
Figure 12:
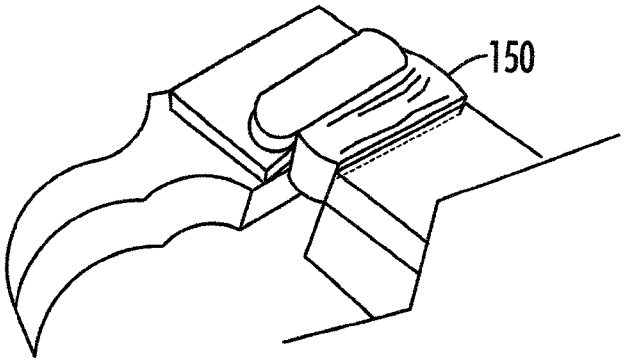
FIG. 12 is a schematic view of the internal L shaped trigger energy absorption device of FIG. 11 compressed.
Figure 13:
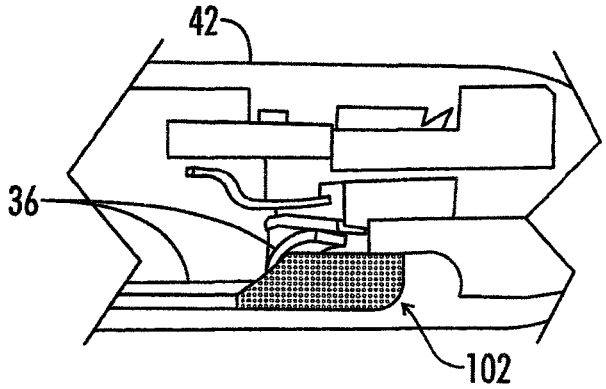
FIG. 13 is a schematic view of an elongated trigger energy absorption device inside a military and police style frame assembly.
Figure 14:
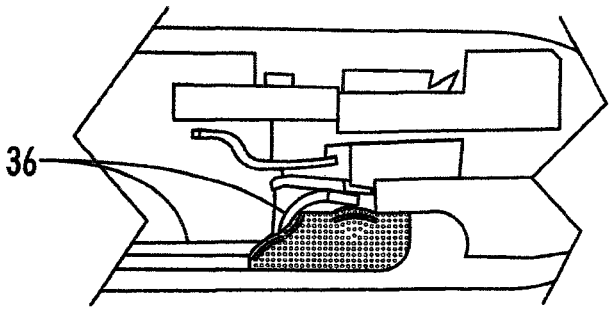
FIG. 14 is a schematic view of the elongated trigger energy absorption device of FIG. 13 compressed.
Figure 15:
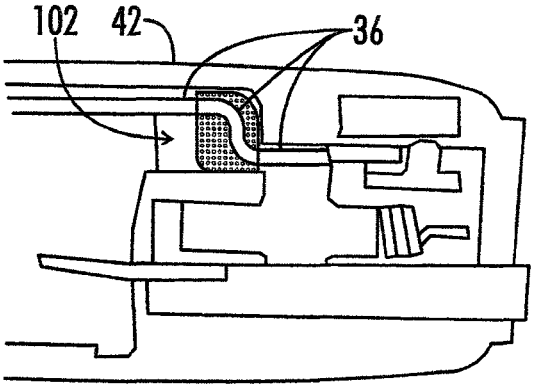
FIG. 15 is a schematic view of a trigger energy absorption device inside another frame assembly configuration.
Figure 16:
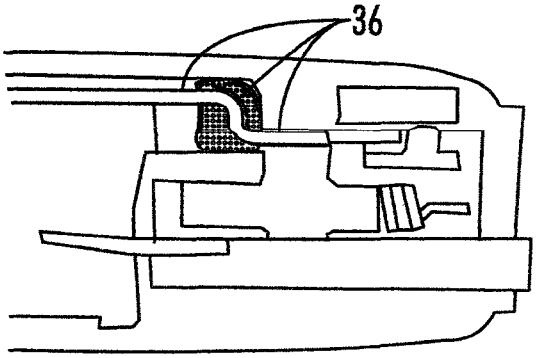
FIG. 16 is a schematic view of the trigger energy absorption device of FIG. 14 compressed.
Figure 17:
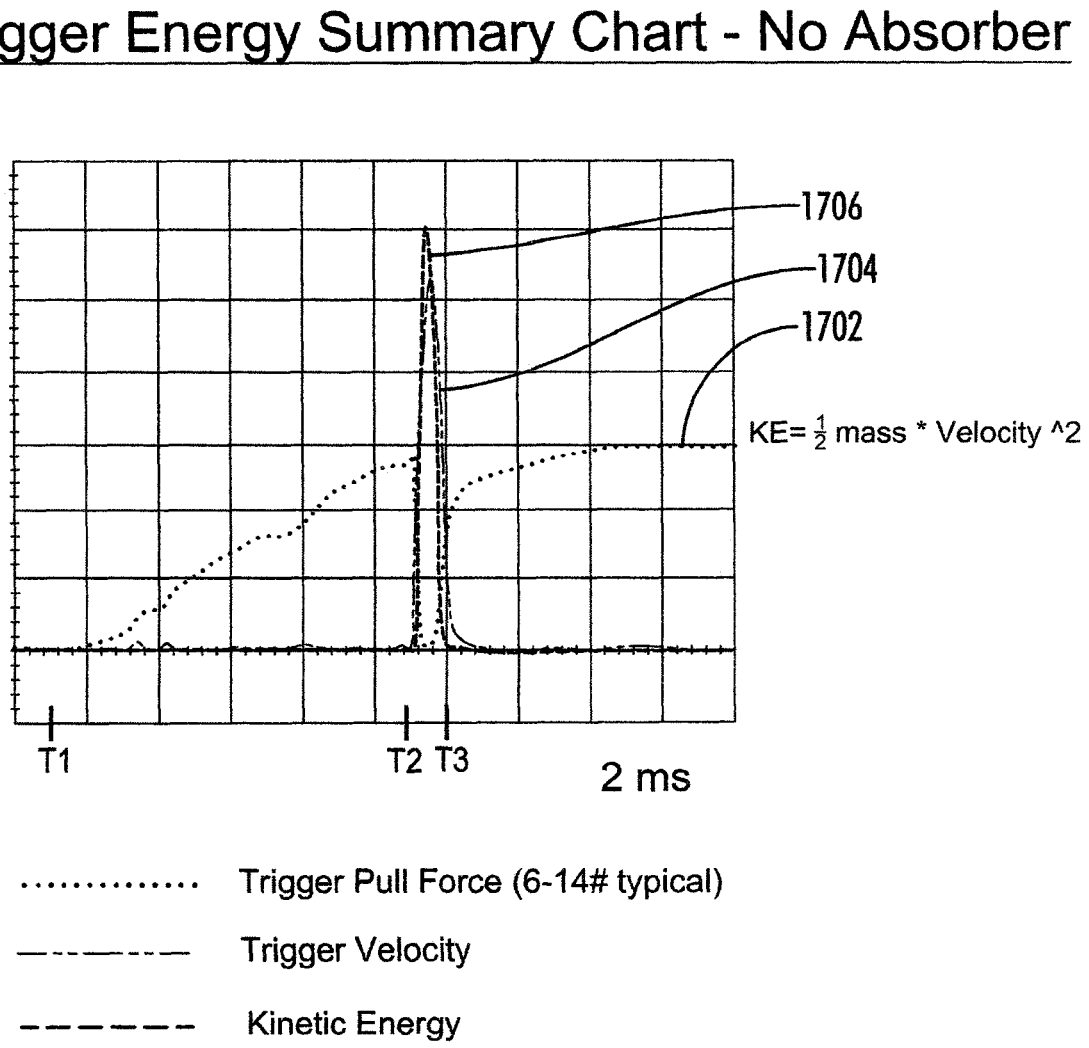
FIG. 17 is a graph of an undampened trigger pull force, trigger velocity, and shock energy.
Figure 18:
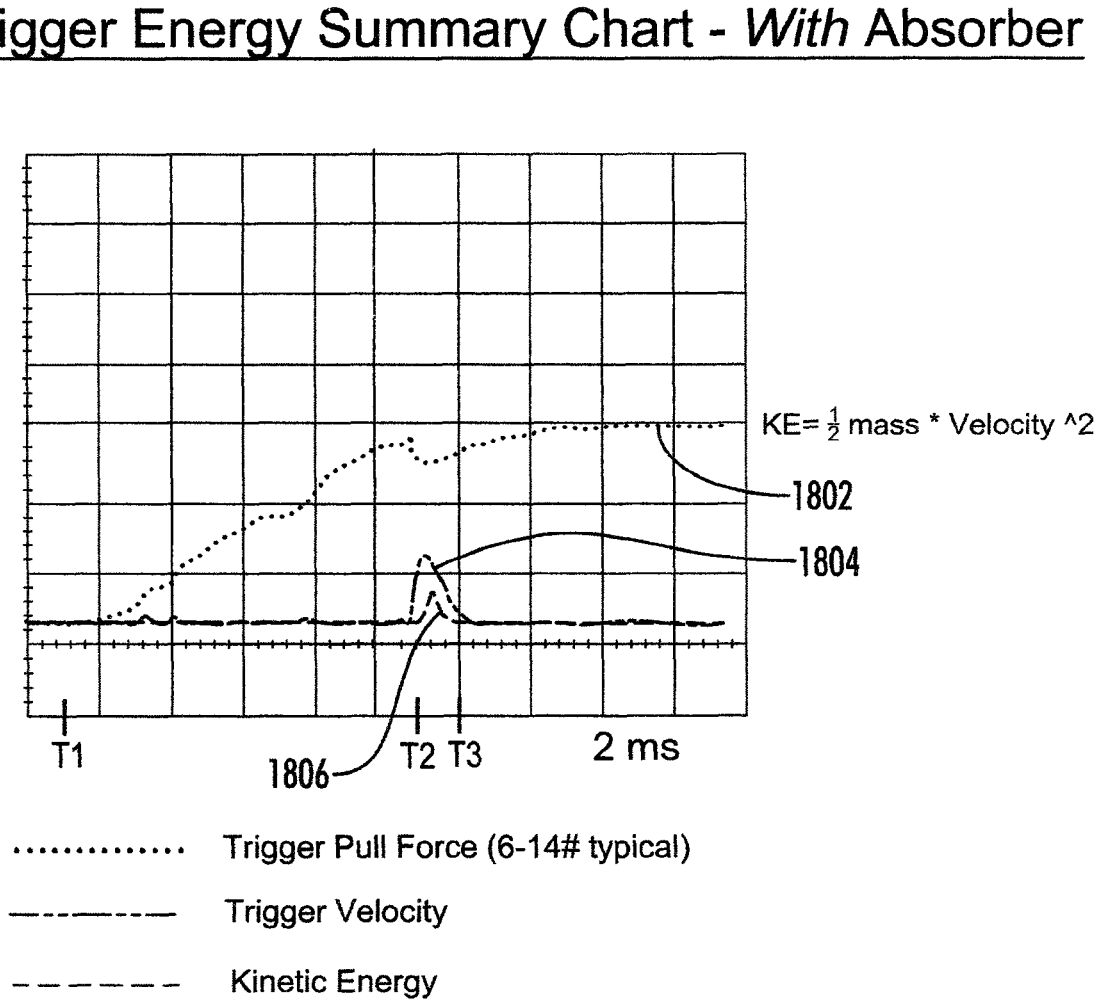
FIG. 18 is a graph of a dampened trigger pull force, dampened trigger velocity, and dampened shock energy when using a trigger energy absorption device.
Figure 19:
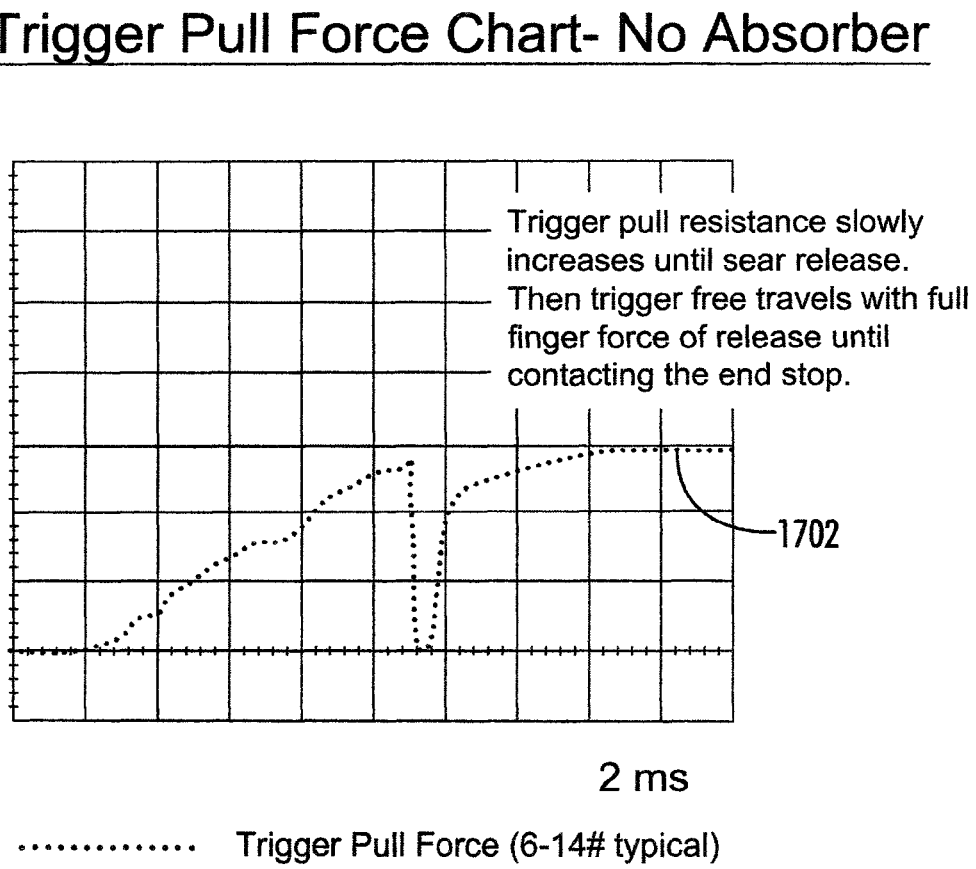
FIG. 19 is a graph of an undampened trigger pull force.
Figure 20:
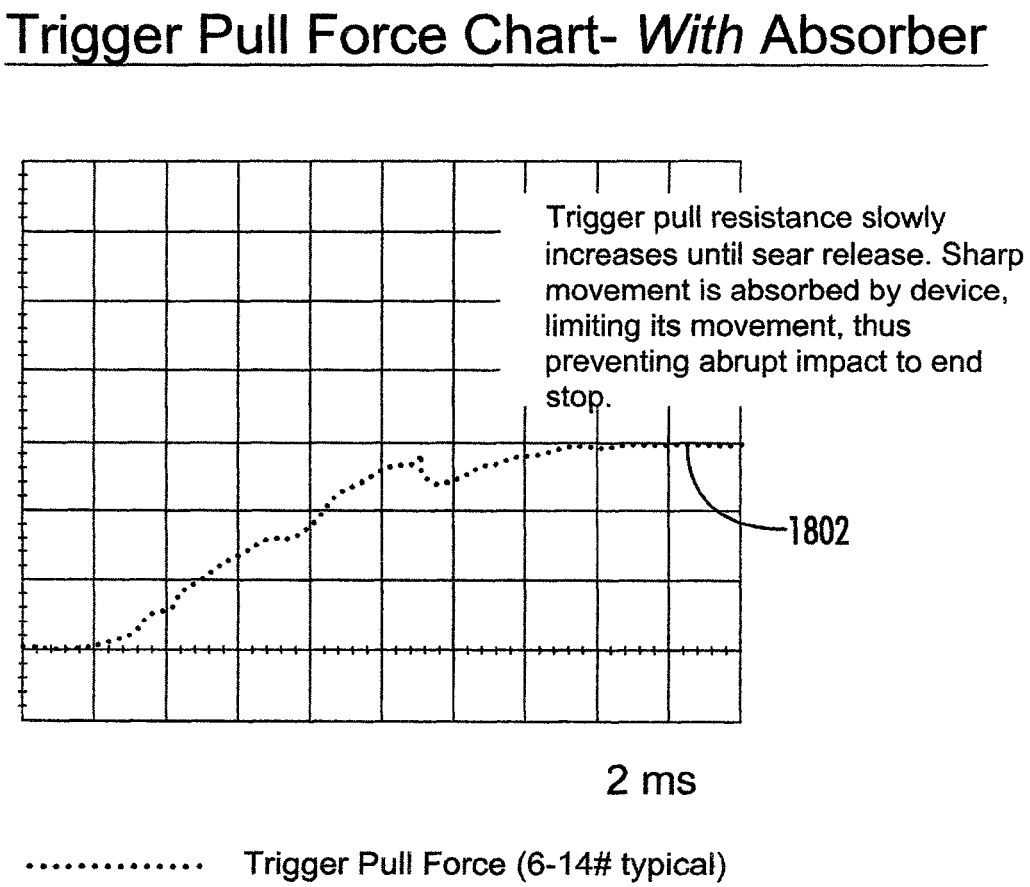
FIG. 20 is a graph of a dampened trigger pull force when using a trigger energy absorption device.
Figure 21:
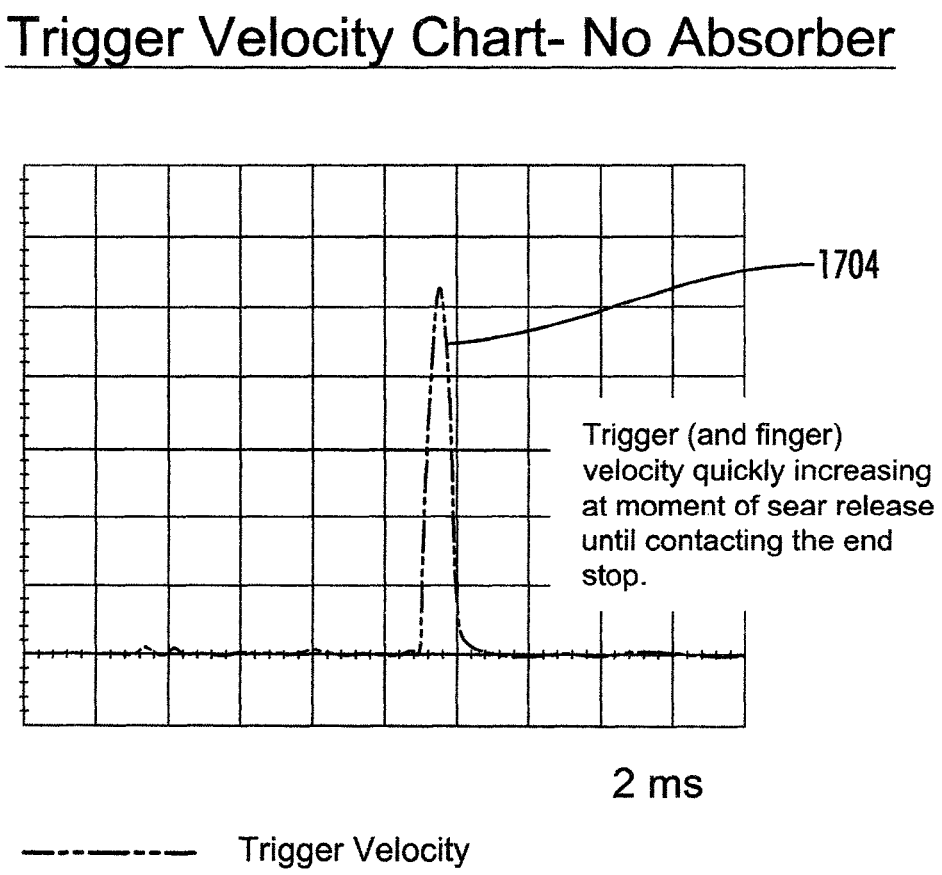
FIG. 21 is a graph of an undampened trigger velocity.
Figure 22:
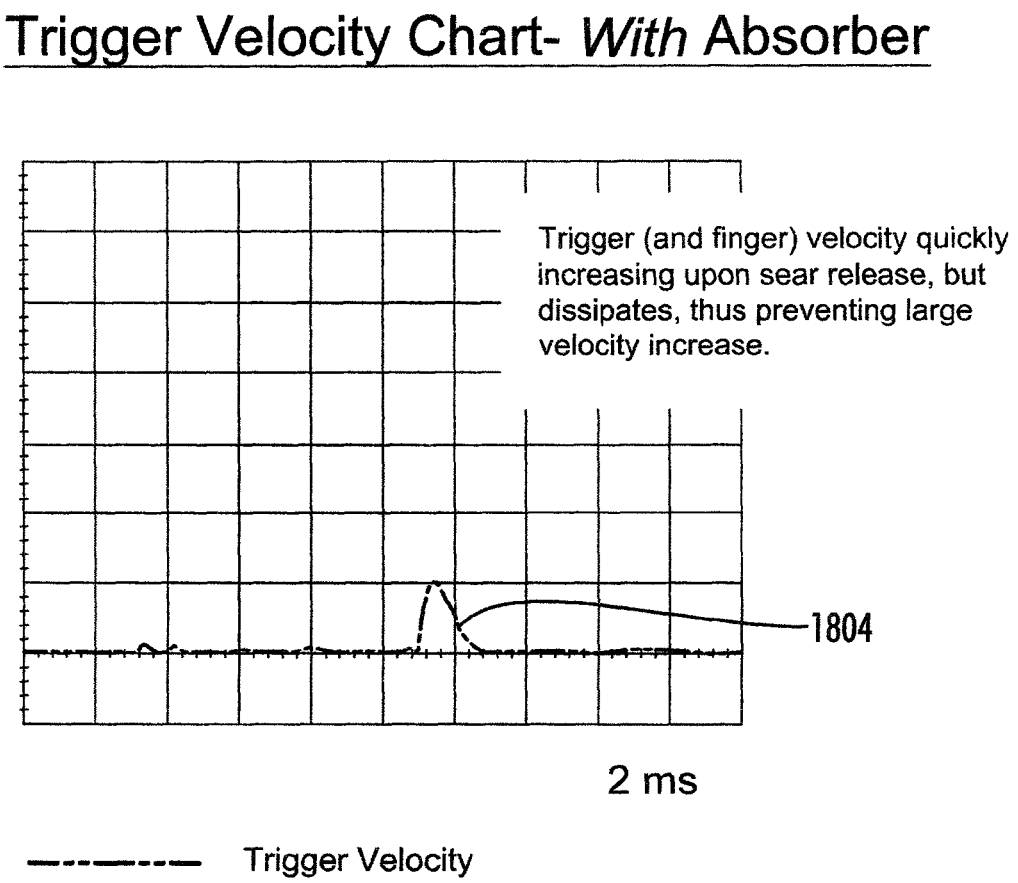
FIG. 22 is a graph of a dampened trigger velocity when using a trigger energy absorption device.
Figure 23:
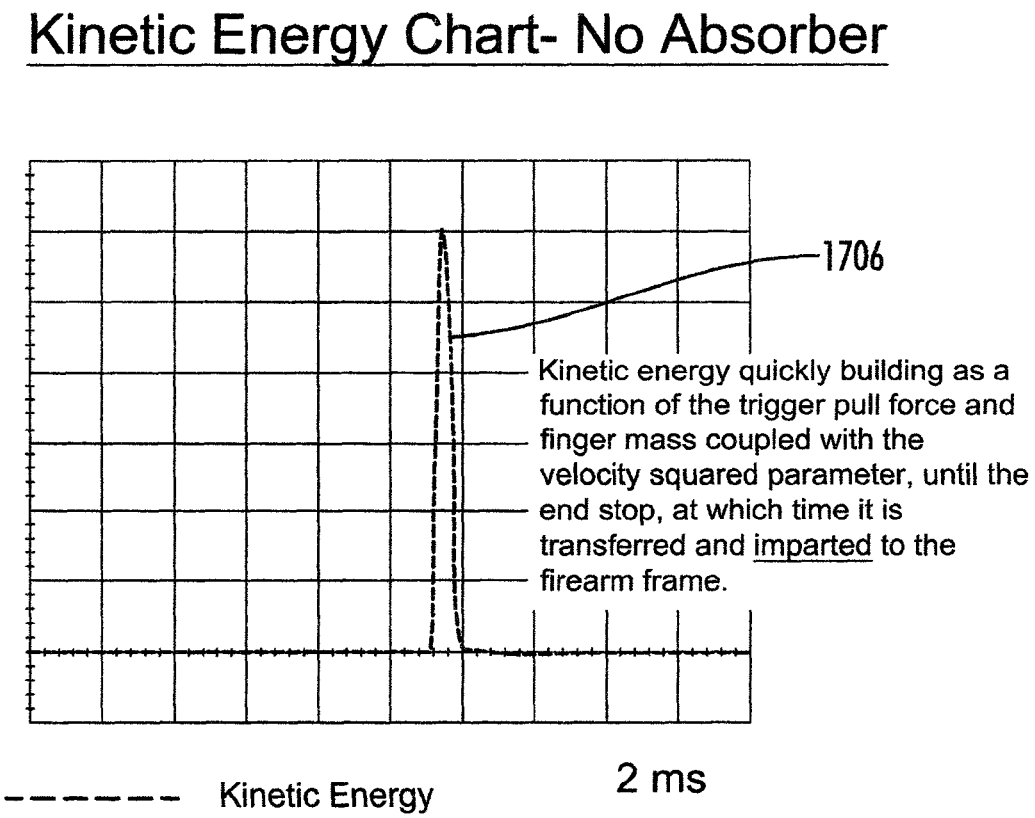
FIG. 23 is a graph of an undampened shock energy.
Figure 24:
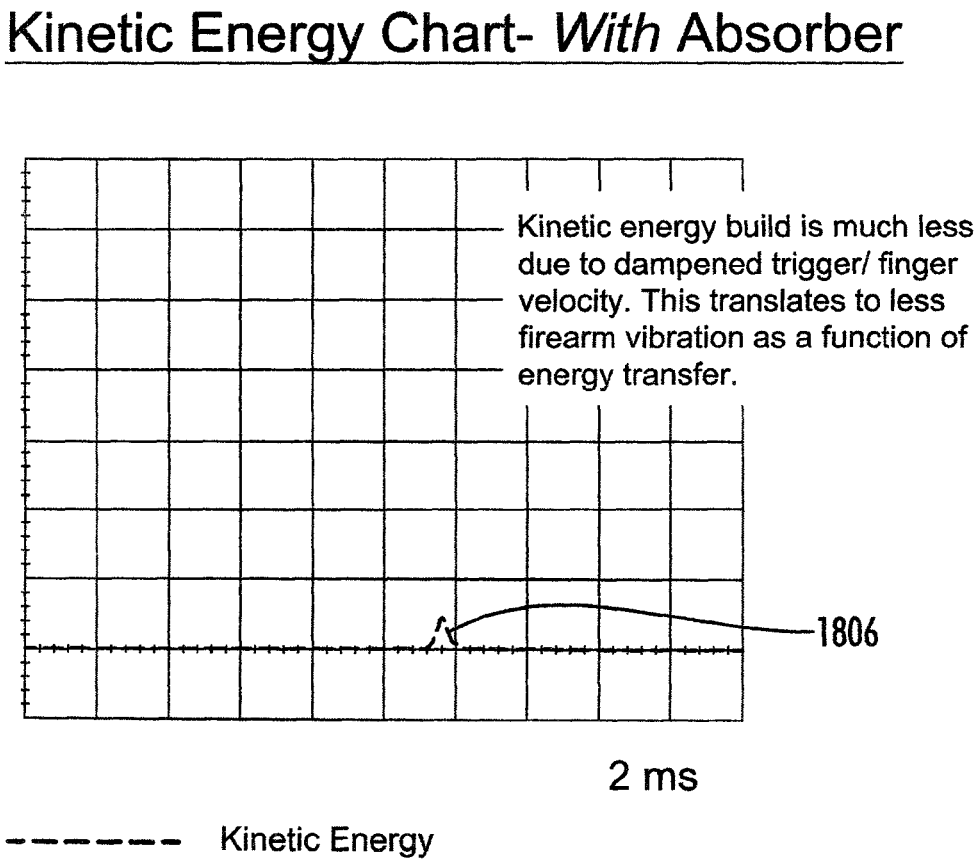
FIG. 24 is a graph of a dampened shock energy when using a trigger energy absorption device.

FIGS. 1-9 show the trigger energy absorption device 100 in an external frame assembly mounting 104 and FIGS. 11-16 show an internal frame assembly mounting 102. Basically, FIG. 11 shows the mounting in a SIG P320 (trademark) and FIG. 12 shows the compression of the device 100, FIG. 13 shows the mounting in a SMITH & WESSON M&P9MM (trademark) and FIG. 14 shows the compression of the device 100, and FIG. 15 shows the mounting in a GLOCK 19 (trademark) and similar and FIG. 16 shows the compression of the device 100. In this manner, both internal and external mountings may be understood.

Operation and Absorption

To understand operation of the invention, the following details are provided with a simplified example of handgun operation so that one may understand the invention. The invention originated from an observation during dry fire practice, aka non-live practice, with a lightweight handgun firearm 10 that the front sight 60 to rear sight 70 alignment of the firearm 10 tended to move a slight amount at what seemed to be the exact moment of firing pin release. Realizing that this movement is detrimental to firearm 10 accuracy and repeatability, efforts were taken to improve the user's grip skill. While improving the grip helped with both dry fire and live fire operation of the handgun firearm 10, there was still an annoying movement in the front sight 60 as noted above and the accuracy of the firearm 10 was still subpar. The next approach was to take the traditional route of improving the trigger assembly 20 release by installing a match competition grade trigger spring, with the supposed benefit of increasing accuracy via reducing the trigger pull required to fire the firearm 10. The effect did seem to slightly improve accuracy, but the reduced trigger assembly 20 force meant that the firearm 10 was easier to fire both intentionally and unintentionally. Also, the front sight still moved an excessive amount during live fire and dry fire practice. Again, the accuracy was less than satisfactory.

When considering where this front sight movement was originating, consideration went to a visualize of the action of the firearm at a sub-second timing level. It became clear that while trigger assembly 20 to sear 80 release tension is important, the energy in motion from the trigger assembly 20 after sear 80 release has a profound impact on the accuracy of the firearm 10. As the humorous adage goes, 'it's not the fall that kills you: it's the sudden stop at the end!' This thought applies to firearm trigger assembly 20 release. It's not the trigger assembly 20 release that kills firearm 10 accuracy, it's the sudden stop of the trigger assembly 20 against the rest of the frame assembly 42. Here, the trigger assembly 20 is defined as the mechanism moved by the user's finger in relation to the frame assembly 42. The potential energy built up on the trigger assembly 20 by the finger is suddenly released which causes an acceleration of the trigger assembly 20 all the way to the sudden stop in movement of the trigger assembly 20 where the energy of the trigger velocity is transferred to the frame assembly 42.

A greatly simplified trigger assembly 20 and release of an internal sear 80 in a frame assembly 42 is shown in FIGS. 1 through 3. FIG. 1 shows the sear 80 engaged with the trigger assembly 20 note how there is an air gap separating the trigger energy absorption device 100. FIG. 2 shows the sear 80 releasing from the trigger assembly 20 and how the air gap has been closed. FIG. 3 shows the trigger energy absorption device 100 absorbing the energy via compression and transferring it to the frame assembly 42, specifically transferring the energy to the grip handle 45. In this manner, the main body 110 is compressed after the release motion has been initiated Thus, one may understand the trigger assembly 20 movement the transfer of energy to the frame assembly 42 and the absorption of energy after the sear 80 release. In application, one may consider this concept applied to modern firearm 10 design. Typical modern handgun firearm 10 design is currently migrating toward a striker fired mechanism for the firing pin. Striker fired weapons utilize a spring coiled pin that must be held in tension and released by a sear 80 which is controlled by a trigger assembly 20. The sear 80 release for the firing pin can be of significant load depending on manufacturer. This load, which must be overcome by the shooter with the force of the trigger assembly 20 finger, is usually around six to seven pounds of pulling force. Once the required pulling force for sear 80 release is achieved, the firing pin is released to make impact on the ammunition primer and fire the weapon. However, simultaneous to this, the trigger assembly 20, now released of the resistance load of the sear 80, travels with an increasing velocity all the way to its end stop. Due to the fact that the released trigger assembly 20 motion is not normally absorbed or halted until this end stop, the finger and trigger assembly 20 quickly gain velocity and kinetic energy. Kinetic Energy is defined by KE=½ mass times velocity squared. Once the trigger assembly 20 reaches the abrupt end stop, this kinetic energy is then transferred to the firearm frame assembly 42 which is transferred to the user's grip which causes shock load instability in the frame assembly 42. This occurs at the same general time that the ammunition is being ignited and propelled down the barrel. Due to the fact that modern polymer handguns are so light, with typical mass for a sub-compact pistol being around 24 oz., the imparted energy to weight ratio becomes significant. A six-pound trigger pull is 96 oz, which his 4 times the weight of the handgun firearm 10 itself! This results in a weapon that has a tendency to shake or shift due to imparted kinetic energy. Therefore, the most accurate guns in production generally happen to be amongst the heaviest, and this is also why the light weight polymer frame weapons generally exhibit relatively poor accuracy. These characteristics noted are also prevalent in hammer fired or other percussion style firearms.

FIGS. 17-24 show graphs with the base line trigger pull force 1702, base line trigger velocity 1704 of movement, and the base line kinetic energy transfer 1706 to the frame assembly 42 compared against the dampened trigger pull force 1802, dampened trigger velocity 1804 of movement, and the dampened kinetic energy transfer 1806. Using the simple formula of Force=Mass*Acceleration, one can understand that the trigger assembly 20 and finger mass remain the same. However, the acceleration greatly increases after the trigger assembly 20 release, in FIGS. 17-24 look at time T1 for the start of the pull, time T2 for the start of the trigger assembly 20 release of the sear 80, and T2 to T3 for the difference in dampened versus undampened. Simply understood from FIG. 1, the force provided by the finger that is used to overcome the internal friction and move the trigger assembly 20 to the release point continues to be applied by the finger such that the prior art open gap behind the trigger back 27 that extends to the hard stop allows the trigger assembly 20 to increase in acceleration at times T2 to T3 until the trigger contacts the hard stop of the frame assembly 42 at time T3. On solid or sliding trigger 20 designs, this hard stop may be internal to the frame assembly 42 such as those shown in FIGS. 11-16. At this point, the kinetic energy=0.5*mass*velocity*velocity. Because the acceleration has resulted in a finger and trigger assembly 20 velocity across the prior art air gap, a large jarring force is generated and transferred to the frame assembly 42 pulls the sights 60, 70 out of alignment. Thus, as acceleration increases, so does the jarring force generated for a given mass. Now look at the contrast between FIG. 17 and FIG. 18 and note that in contrast to the large open air gap of the prior art, the present invention uses the trigger energy absorption device 100 to absorb the trigger pull force after the trigger assembly 20 release. As shown by FIGS. 18, 20, 22, and 24, through the absorption of this unneeded pull force, the after release acceleration of the trigger assembly 20 is greatly reduced such that very little jarring force is transferred to the frame assembly 42. By comparing the prior art open air gap graph of FIG. 17 to the trigger energy absorption device 100 filled gap graph of FIG. 18, one can see that the velocity 1704, 1804 is reduced because the trigger assembly 20 does not have as significant of an acceleration because the energy 1706, 1806 is absorbed and released by the elastomer dampening body material 150 in a cushioned manner instead of a shock load.

Figure 25:
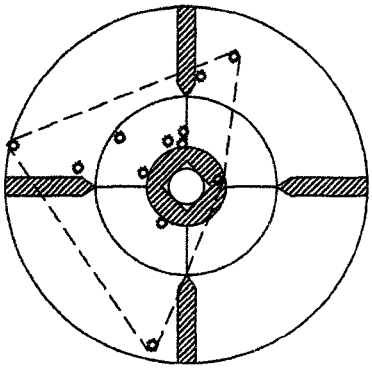
FIG. 25 shows real world target results of absorption on weapon accuracy.
Figure 25:
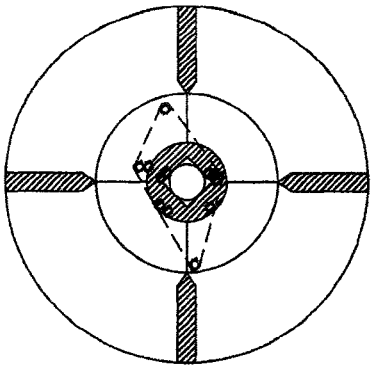
Figure 25:
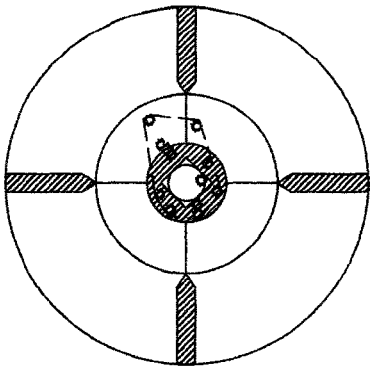

FIG. 25 shows the end result of this absorption on weapon accuracy using a SIG SAUER P320 (trademark) at a distance of 20 yards with twelve rounds per target. Figure A shows the result without the absorption device with a 27.4 square inch group area. Contrast Figure A against Figure B and Figure C, where Figure B with a 6.05 square inch area shows the result of an external device and Figure C with a 4.53 square inch area shows the results of an internal device.

The external device provides a 78% improvement in group area and the internal device provides an 84% improvement.

Figure 26:
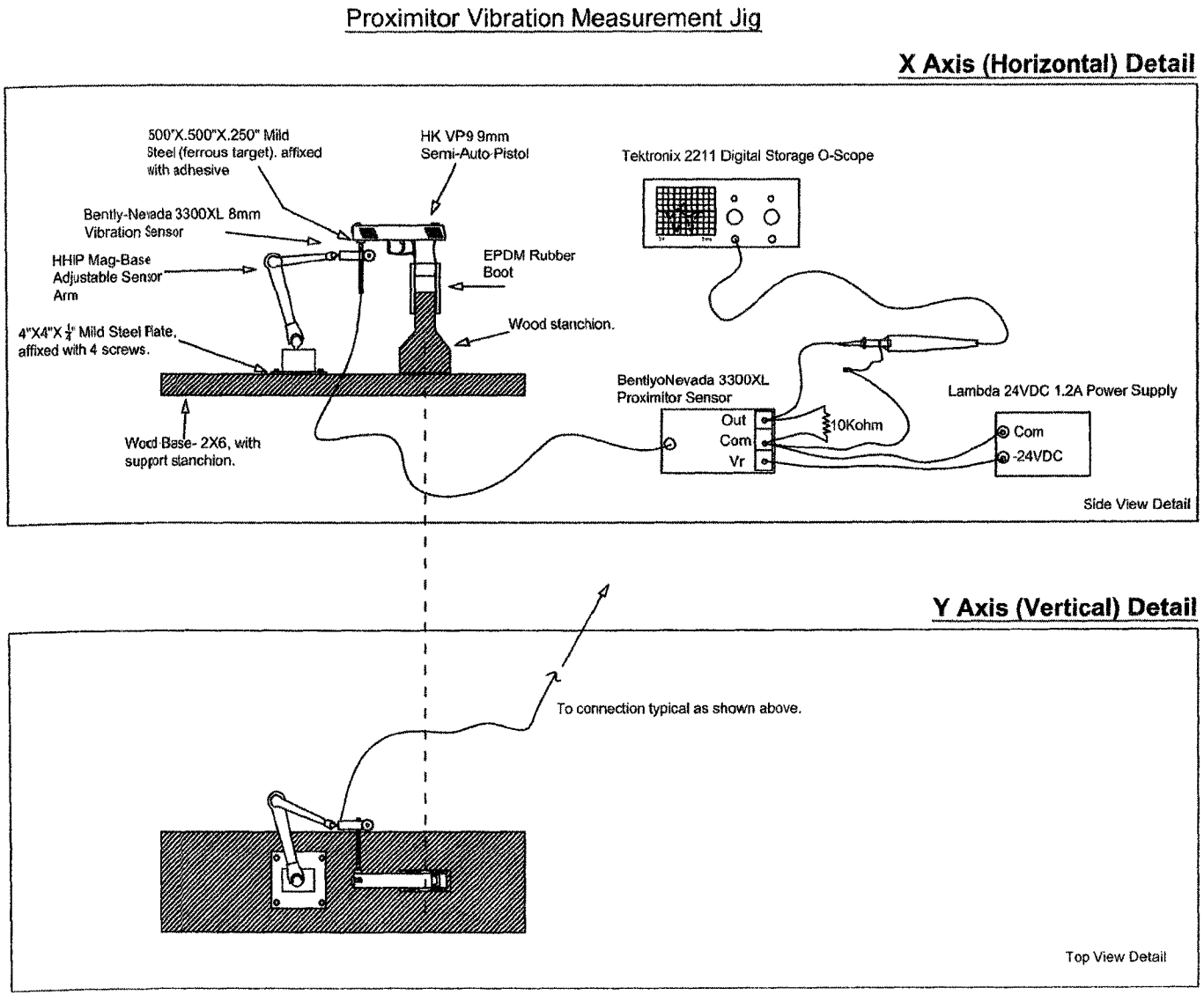
FIG. 26 shows proximeter measurement setup
Figure 27:
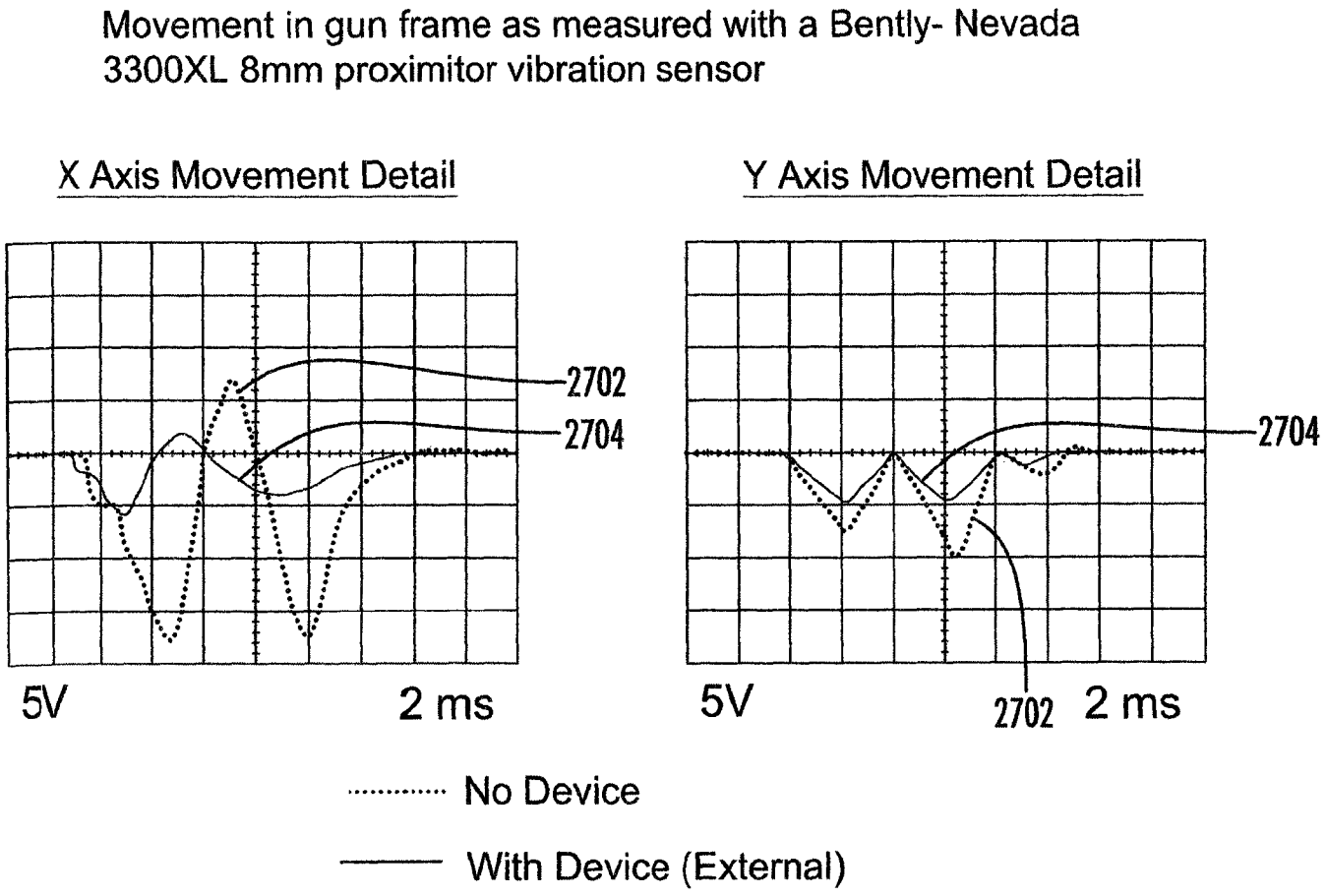
FIG. 27 shows contrasting differences using the device in the proximeter setup.
Figure 28:
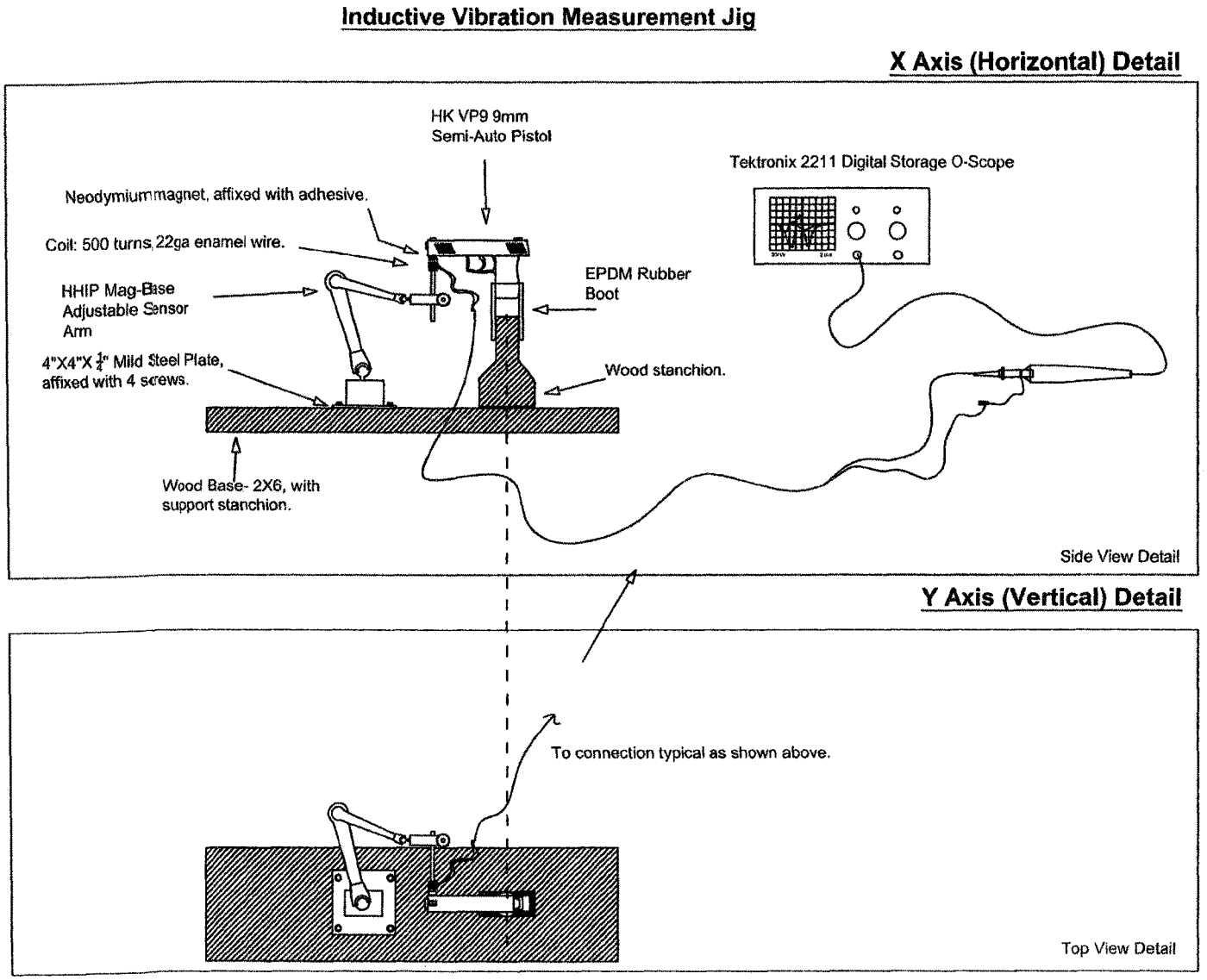
FIG. 28 shows the inductive vibration measurement setup.
Figure 29:
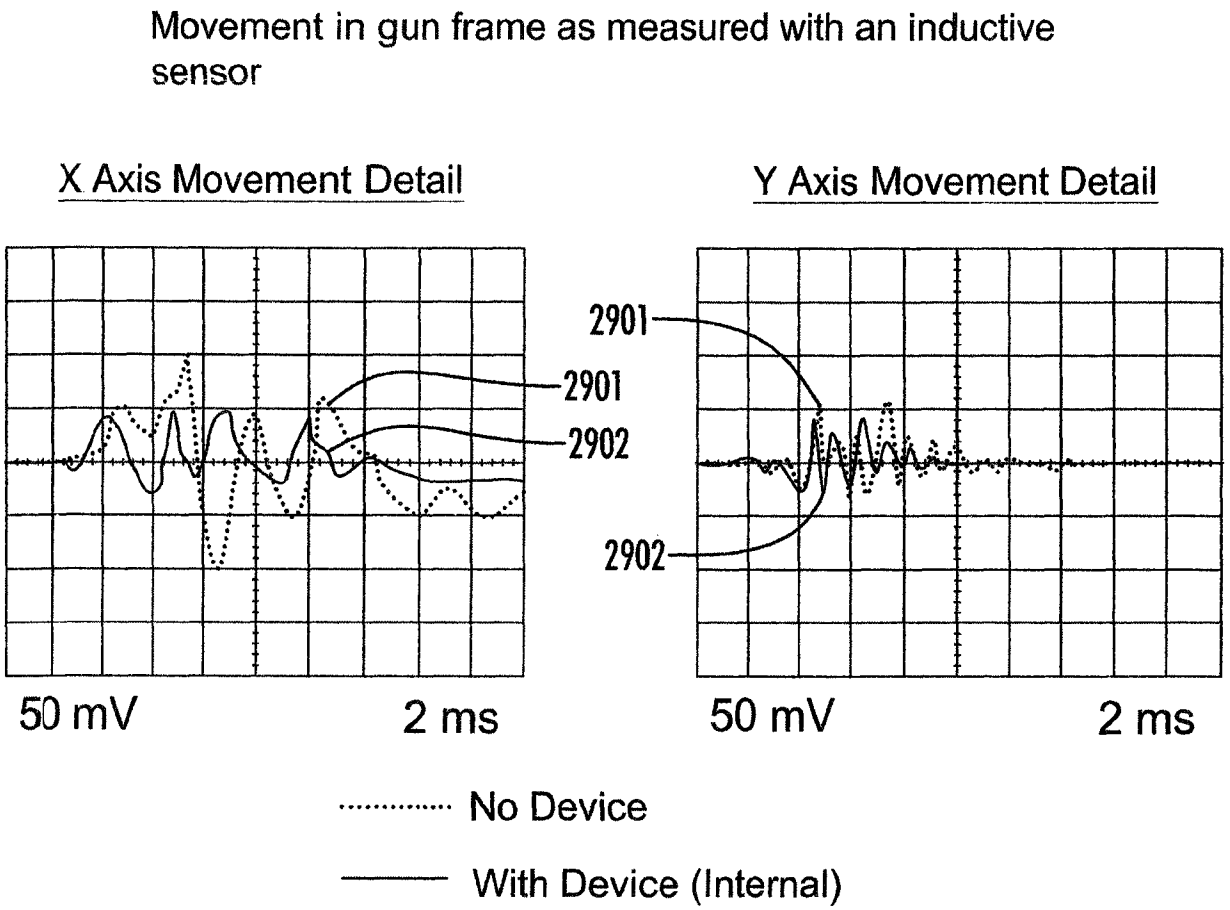
FIG. 29 shows contrasting differences using the device in the vibration setup.

FIG. 26 through 29 show how the vibration of the pistol is reduced as measured by two different sensor types. FIG. 26 shows the proximeter measurement setup with FIG. 27 contrasting the differences between the no device measurements 2701 and the with device measurements 2704. FIG. 28 shows the inductive vibration measurement setup with FIG. 29 contrasting the differences between the no device measurements 2701 and the with device measurements 2704. Note the amplitude reduction in the signal comparison that corresponds with the real world target results presented in FIG. 25.

Figure 30:
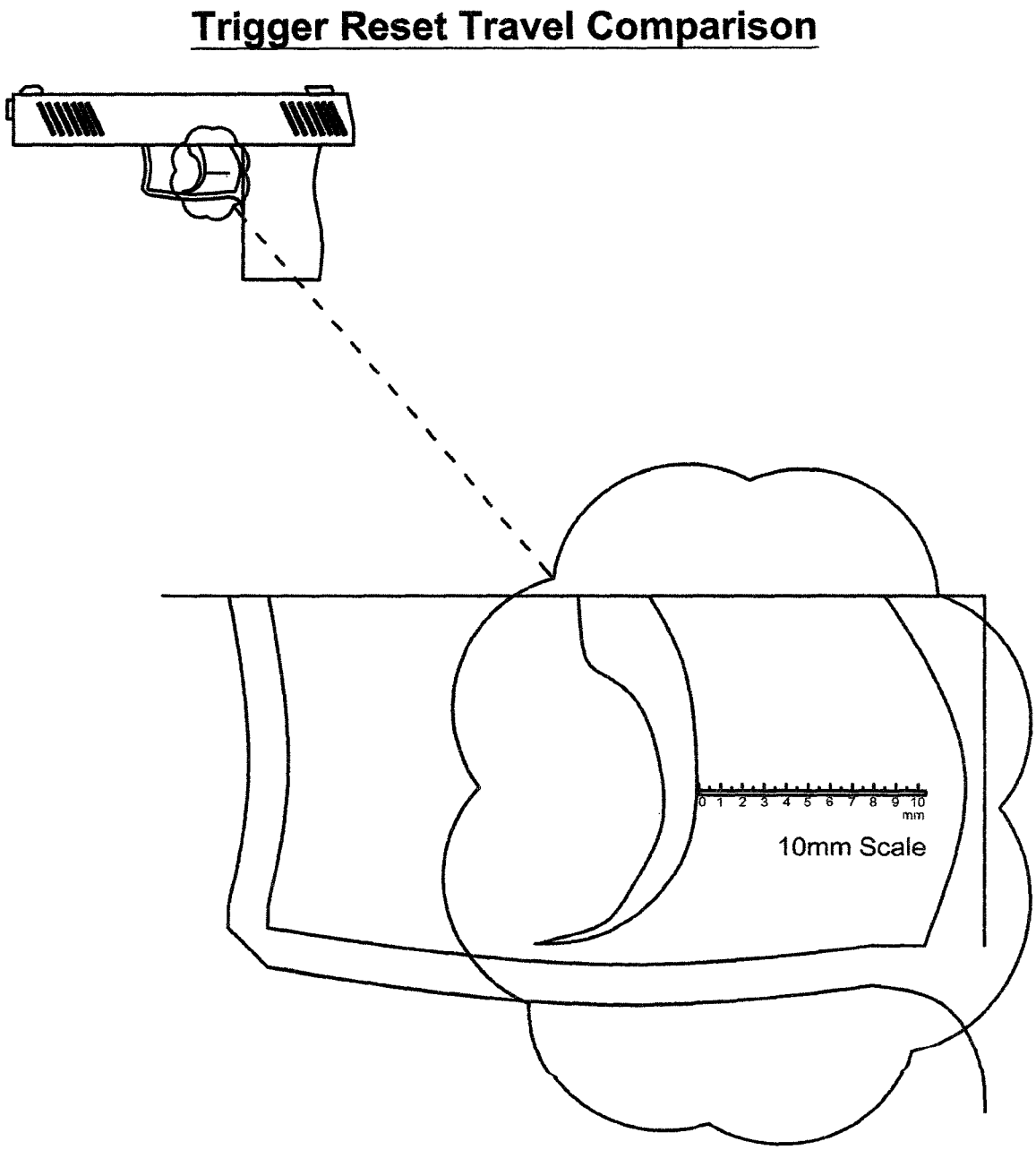
FIG. 30 shows a measurement scale for a trigger application of an energy absorption device 100.
Figure 31:
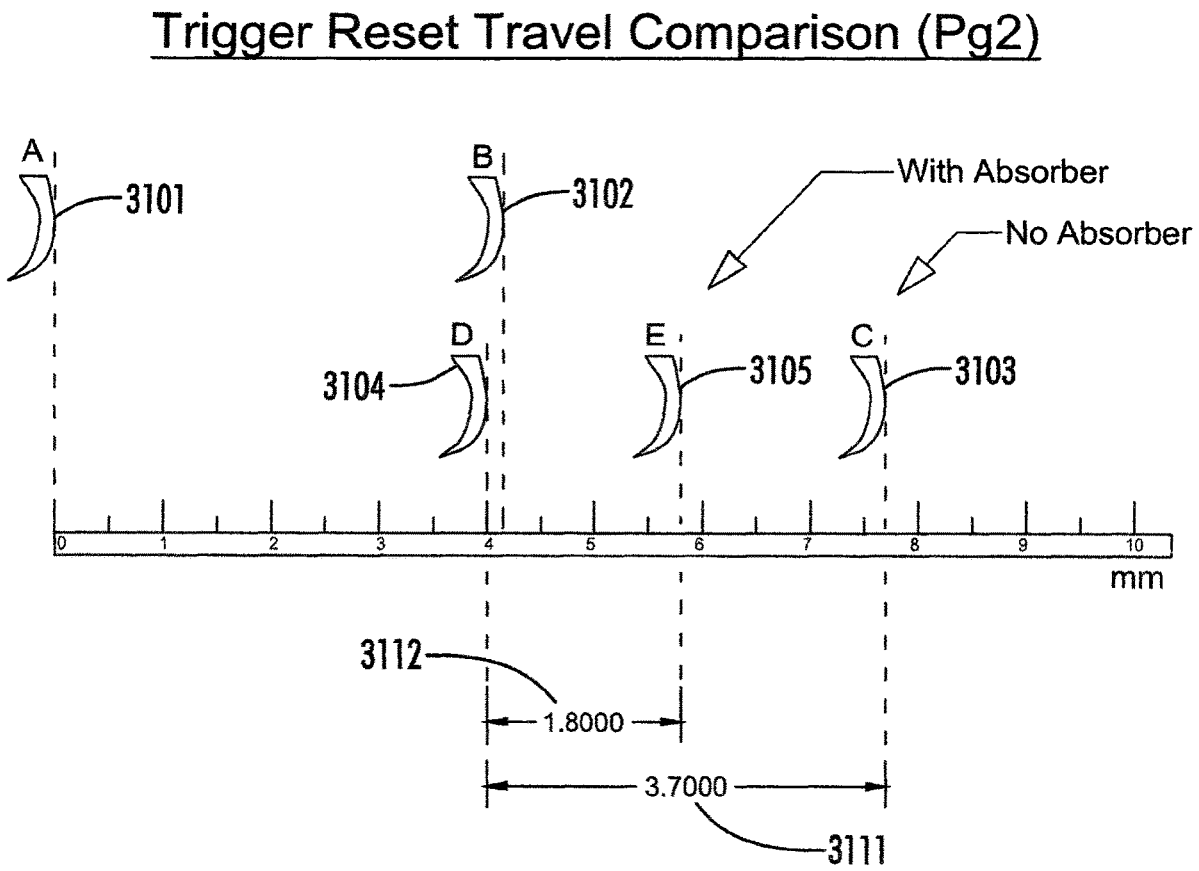
FIG. 31 shows the contrasting relative positions of trigger travel with the device.
Figure 32:
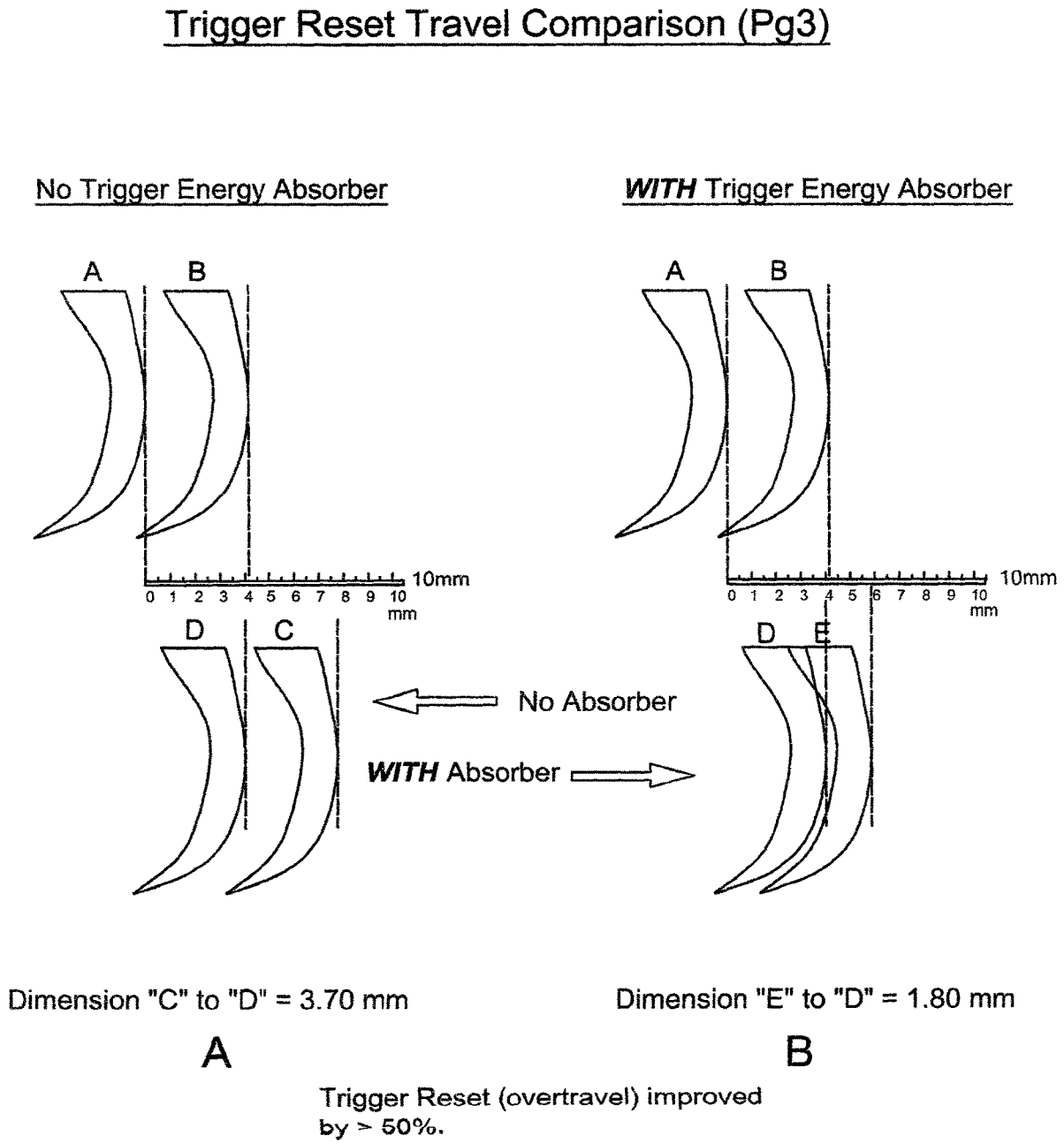
FIG. 32 shows a comparison end stop to reset measurement.

FIGS. 30-32 show an added benefit of the trigger energy absorption device 100 in the reduction in over travel of the trigger assembly 20 to reduce the total Trigger Reset Travel. For this description, we can look at an external mount and measure the movement of the trigger back, but one should understand that this applies to internal devices as well. As noted by FIG. 30, the diagrams are based on 10 mm measurement scale using a HECKLER & KOCH VP9 (trademark) and a closed cell polyethylene foam of four pound density affixed as an external trigger energy absorption device 100. Note that the schematic drawings are drawn for illustrative purposes and are not actually to scale. Similar measurement results have been shown with various other weapons, with both internal and external embodiments.

FIG. 31 shows the schematic positions of trigger travel from the at rest position 3101, through the sear release position 3102, to the no absorber end stop position 3103 and back to the trigger reset position 3104. The trigger energy absorption device 100 changes the end stop position to an absorber end stop position 3105, but otherwise the trigger positions remain the same. FIG. 31 shows the difference between the no absorber end stop to reset measurement 3111 of 3.7 mm and the reduction in the with absorber end stop to reset measurement 3112 of 1.8 mm.

FIG. 32 shows a comparison of the no absorber end stop to reset measurement 3111 of 3.7 mm and the reduction in the with absorber end stop to reset measurement 3112 of 1.8 mm. Note the corresponding reduction in overtravel which represents an improvement of greater than fifty percent.

In final summary, it may be noted that the traditional approach to mitigate the shock of trigger release into the firearm has been to lighten the trigger pull. Standard trigger pull weights being anywhere from 6# up to 14#. While this positively affects the performance, this approach has focused on the "mass" parameter of the kinetic energy equation, which has a multiplier of 0.5. The velocity of trigger movement, after release, is of much more relevance because it has a squared component in the equation. Therefore, velocity dampening is the primary purpose and key feature of this device, although other positive attributes become realized with it's application. Absorption may be accomplished via internal or external embodiment.

Reference numerals used throughout the detailed description and the drawings correspond to the following elements:

- firearm 10
  - Trigger assembly 20
    - Reset motion 21
    - Release motion 22
  - Trigger body 25
    - Trigger front 26
    - Trigger back 27
  - Movement connection 30

-continued

- Trigger pivot 32
- Trigger slide 34
- Trigger arm 36
- Gun body 40
  - Frame assembly 42
    - Upper frame assembly 43
    - Trigger guard 44
    - grip handle 45
      - Front strap 46
      - Back strap 48
      - Side panel 50
    - Front sight 60
    - Rear sight 70
    - Sear 80
- Trigger energy absorption device 100
  - internal frame assembly mounting 102
  - external frame assembly mounting 104
  - Main body 110
    - Body shape 112
      - Increasing body shape 113
      - Consistent body shape 114
      - Decreasing body shape 115
      - Hollow body shape 116
        - Body threads 117
      - Varying body shape 118
    - body front 120
      - body front concave shape 122
      - body front convex shape 124
      - body front pointed shape 126
      - body front flat shape 128
    - body back 130
      - body back concave shape (not shown)
      - body back convex shape 134
      - body back pointed shape (not shown)
      - body back flat shape 138
    - Body top 140
    - Body bottom 142
    - Left side 144
    - Right side 146
  - Dampening body material 150
  - Body adhesive 160
  - Mounting structure 170
    - Rod mount 172
    - Mounting threads 174
  - trigger pull force 1702
  - velocity of movement 1704
  - energy transfer to the frame assembly 1706

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A trigger energy absorption apparatus for use with a firearm having a trigger assembly moveably mounted for both a reset motion and a release motions in relation to a frame assembly, the trigger assembly including a trigger body defining a trigger back, the apparatus comprising:

a trigger energy absorption device including a main body made from an elastomer, the main body mounted as an external frame assembly mounting;

the main body defining a hollow body shape;

the hollow body shape defining body threads;

a mounting structure connected to the trigger body, the mounting structure defining mounting threads sized to engage the body threads.

* * * * *